United States Patent [19]

Subherwal

[11] Patent Number: 4,684,061

[45] Date of Patent: Aug. 4, 1987

[54] WATER HEATER SECONDARY CONTROL DEVICE

[75] Inventor: Bodh R. Subherwal, Huntington Beach, Calif.

[73] Assignee: BR Laboratories, Inc., Huntington Beach, Calif.

[21] Appl. No.: 779,203

[22] Filed: Sep. 23, 1985

[51] Int. Cl.[4] ..... F23N 1/08

[52] U.S. Cl. ..... 236/20 R; 126/374; 219/334

[58] Field of Search ..... 236/20 R, 68 D; 126/374, 362; 219/508, 334

[56] References Cited

U.S. PATENT DOCUMENTS 2,806,652 9/1957 Arden et al. ..... 236/21 B
3,172,601 3/1965 Caparone ..... 236/68 D
3,272,432 9/1966 Davidson ..... 236/21 B
3,367,571 2/1968 Wantz et al. ..... 236/68 D

*Primary Examiner*—William E. Wayner
*Attorney, Agent, or Firm*—Nilsson, Robbins, Dalgarn, Berliner, Carson & Wurst

[57] ABSTRACT

A water heater secondary control device which terminates the flow of gas to the heater thermostat when water has not been withdrawn from the tank for a period of time. The secondary control device includes a temperature sensor attached directly to the outside of the cold water inlet pipe and a tube to be attached to the heater tank pilot line to provide a continuous pilot light. The secondary control device is inserted between the natural gas pipe inlet and the heater thermostat and prevents flow of gas to the burner through the thermostat when the temperature of the water in the cold water inlet is above a predetermined threshold.

3 Claims, 2 Drawing Figures

WATER HEATER SECONDARY CONTROL DEVICE

BACKGROUND OF THE INVENTION

The present invention generally relates to water heaters and, more particularly, is concerned with a device for controlling the flow of gas to the heater thermostat.

Water heaters usually have a cold water inlet pipe, a hot water outlet pipe and an exhaust or vent pipe all connected to the top of a reservoir or tank. Most water heaters currently utilize natural gas to heat the water within the tank. A heater thermostat attached to the tank controls the flow of gas to a main burner which is usually below the tank. A pilot line for igniting the main burner is also attached to the heater thermostat. After the water within the tank is heated it rises from the bottom to the top of the tank by convection.

Control devices for water heaters have been designed for many purposes such as controlling the water temperature in the top portion of the tank during frequent withdrawals of water from the tank. A control device may prevent the temperature in the top portion of the tank from approaching an unsafe limit or may assure complete shutdown of gas flow to the main burner when the water temperature excessively rises due to the failure of the heater thermostat. Additionally, the control device may regulate the thermostat temperature as a function of water usage or may direct the supply of water to a low temperature area.

If water is not withdrawn from the tank for a long period of time such as when no one is home, the water temperature eventually drops to a value such that the heater thermostat will activate the main burner to heat the water to the proper temperature. This reheating of water is an unnecessary waste of energy and may be avoided by lowering the temperature limit of the heater thermostat. However, this will cause the temperature of the water withdrawn from the tank during actual use to be undesirably low. Alternatively, a control device which changes the thermostat temperature as a function of usage could be used. However, as with most variable control devices it is complex and expensive. Therefore, a device which would cut off the gas flow to the heater thermostat during periods of nonuse could provide a simple and inexpensive solution to the problem. Thus, there is current need for a device which would terminate the transmission of gas to the heater thermostat during periods of nonuse.

SUMMARY OF THE INVENTION

The present invention provides a water heater control device connected between an energy source and the heater thermostat, the control device including a temperature sensor attached to the outside of the cold water inlet. The control device permits transmission of energy from the source to the heater thermostat when the temperature of the cold water inlet is less than a predetermined amount and terminates such transmission when the temperature of the cold water inlet is equal to or greater than the predetermined amount.

DETAILED DESCRIPTION OF THE PREFERRED EMBODIMENT

Generally, the hot water within a heater tank is always near the top thereof due to convection. Additionally, the cold water inlet pipe, hot water outlet pipe and the exhaust pipe are usually attached to the top of the heater tank. If there is no water withdrawn from the tank for a period of time such as when no one is home, the hot water eventually rises into the cold water inlet pipe which then absorbs the heat from the hot water. However, if water is withdrawn from the tank the hot water at the top of the tank flows through the hot water outlet pipe and does not rise into the cold water inlet pipe. Therefore, if the cold water inlet pipe temperature rises then water has not been withdrawn from the tank for a period of time. If the cold water inlet pipe temperature does not increase then water has been or is being withdrawn from the tank.

By measuring the temperature of the water in the cold water inlet pipe normal operation of the water heater is not disturbed during normal demand cycles. That is, the thermostat permits application of heat from an energy source as required to maintain the water in the tank at the preset temperature determined by the thermostat. However, when the temperature of the water in the cold water inlet rises above a predetermined threshold temperature, indicating nonuse of the hot water, the normal thermostat is effectively removed from the system and a new lower water temperature is substituted until a hot water demand is again sensed. In this manner needless waste of energy to maintain water in the tank at a high temperature is precluded resulting in substantial savings.

Obviously the energy used to heat the heater may be any source known (usually electrical or natural gas) but for purposes of clarity of description and illustration the remaining description will be made with respect to a typical natural gas installation for a residential hot water heater.

Figure 1:
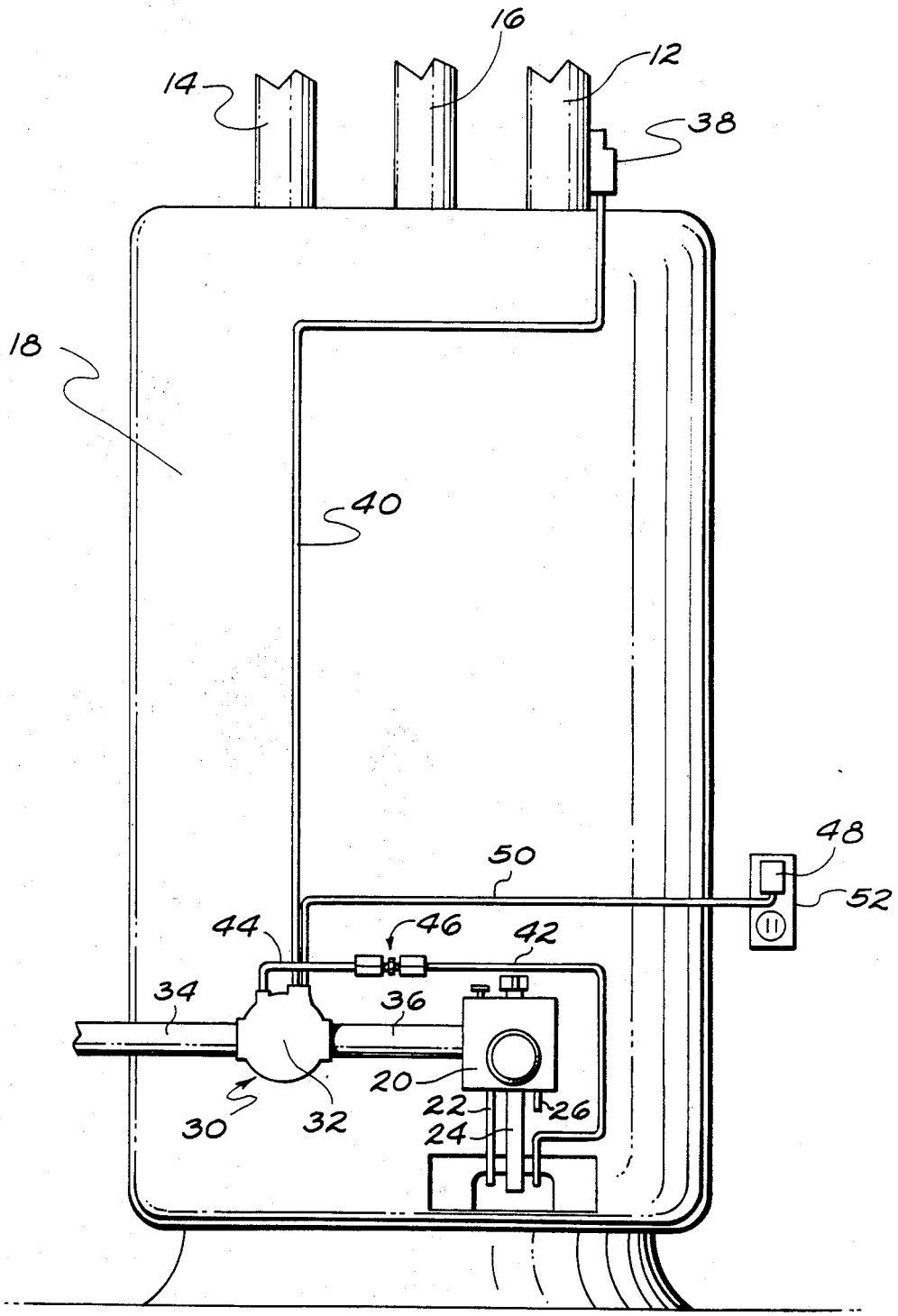
FIG. 1 is a side view of a water heater showing the location of the present invention and various components of the water heater.

Referring to FIG. 1, a cold water inlet pipe 12, a hot water outlet pipe 14 and an exhaust pipe 16 are attached to the top of a hot water tank 18. A heater thermostat 20 maintains the water temperature within the tank at a desired level and is usually attached to the lower portion of the tank 18. The thermostat 20 includes a thermocouple 22 for sensing the water temperature, a gas flow pipe 24 connected to the main burner for heating water and a pilot line 26 for providing a pilot light to the main burner 24. A control device 30 includes a housing 32 connected between a gas input pipe 34 which is connected to a source of gas under pressure (not shown) and a gas output pipe 36 which is also attached to the heater thermostat 20.

The housing 32 may be any shape and constructed of any material but preferably includes two $\frac{1}{8}$ inch thick aluminum or plastic hemispheres held together with appropriate fasteners such as screws or pins. A temperature sensor 38 is attached to the outside of the cold water inlet pipe 12 and sends a signal representative of the water temperature in the pipe 12 to the housing 32 through electrical conductors 40. The temperature sensor 38 senses the temperature of the water in the cold water inlet pipe 12, and if this temperature exceeds a predetermined amount the control device 30 activates to prevent gas flow from input pipe 34 to output pipe 36 thereby terminating the gas flow to thermostat 20 and thence to the burner.

In the preferred embodiment, the predetermined temperature is approximately 127° F. The thermostat pilot line 26 is normally connected to the heater tank pilot line 42. However, if the control device 30 prevents any gas flow to the thermostat 20 there will be no gas flow through the thermostat pilot line 26 thereby extinguishing the pilot light. Therefore, to provide a continuous pilot light, tube 44 extending from housing 32 is attached to heater tank pilot line 42 by compression fitting union connector 46. The control device 30 also includes a transformer 48 which is connected to the housing 32 by electrical conductors 50. Transformer 48 is further connected to a voltage source such as an AC outlet 52. If the control device 30 is utilized in the U.S. transformer 48 is of the 120/24 volt type.

Figure 2:
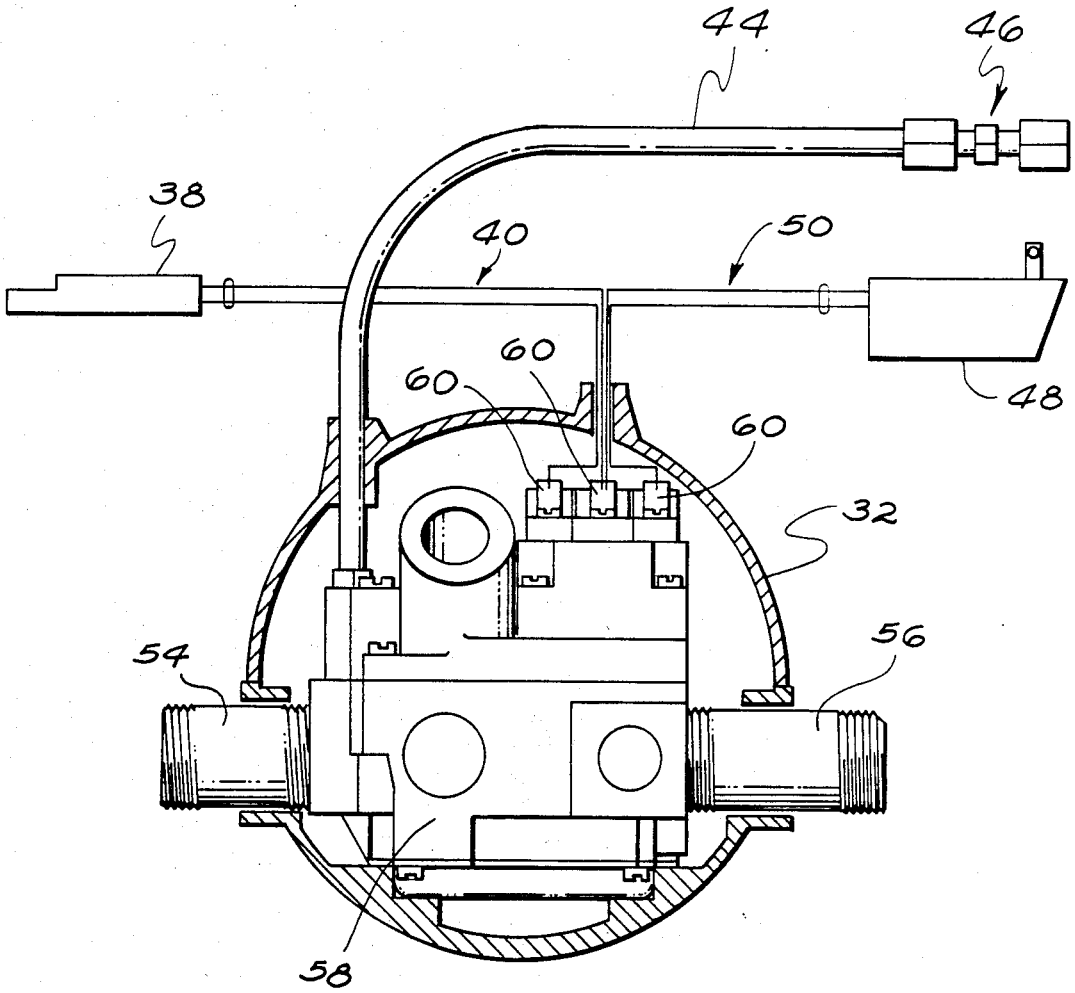
FIG. 2 shows a more detailed illustration of the present invention.

A detailed illustration of the control device can be seen in FIG. 2. A first galvanized nipple 54 is disposed through one side of the housing 12 to engage the gas input pipe 34, and a second galvanized nipple 56 is disposed opposite the first galvanized nipple 54 for engaging the gas output pipe 36. Furthermore, the first and second galvanized nipples 54 and 56, respectively, are attached to a solenoid valve 58 which controls the gas flow to the thermostat 20. The sensor conductors 40 and transformer conductors 50 are attached to solenoid terminals 60 for controlling the solenoid valve 58. Therefore, if the temperature of the water in the cold water inlet pipe exceeds a predetermined amount the solenoid receives a signal from the temperature sensor 38 through conductors 40 such that the solenoid valve 58 closes and prevents gas from flowing from galvanized nipple 54 to galvanized nipple 56. Additionally, tube 44 is connected upstream from the valve 58 thereby allowing gas to flow through the pilot line 42 regardless of the solenoid valve status.

It will now be recognized by those skilled in the art that a relatively simple installation of a secondary control valve in a traditional hot water heater may be accomplished. The homeowner need only: (1) disconnect the natural gas inlet pipe from the thermostat; (2) connect the housing 32 containing the secondary control valve between the gas inlet pipe and the thermostat; (3) disconnect the pilot line from the thermostat and connect it to the housing 32; (4) attach the sensor 38 to the outside of the cold water inlet pipe; and (5) plug the transformer into a wall receptacle. Through utilization of this simple and inexpensive structure energy savings of up to approximately 15% may be realized.

From the foregoing, it has been shown that the present invention provides a control device which terminates the gas flow to the heater thermostat when water has not been withdrawn from the heater tank for a period of time. Although a specific embodiment of the invention has been illustrated and described, various modifications and changes may be made without departing from the spirit and scope of the invention.

What is claimed is:

1. A secondary control device for gas water heaters having a tank, cold water inlet, hot water outlet and a heater thermostat, said control device comprising:

valve means for controlling the flow of gas from a source thereof to said heater thermostat, said valve means connected between said gas source and said heater thermostat;

means attached to the outside of said cold water inlet for sensing the temperature of water in said cold water inlet and providing an electrical signal representative thereof, said signal generated by said temperature sensing means being connected to said valve means;

means for opening said valve means for transmitting said gas to said heater thermostat when said signal is representative of the temperature of said cold water being less than a predetermined temperature; and means for closing said valve means for preventing transmission of said energy to said heater thermostat when said signal is representative of the temperature of said cold water being equal to or greater than said predetermined temperature.

2. The secondary control device as defined in claim 1 wherein said energy is natural gas and said valve means comprises:

a housing;

a first gas conduit means disposed through one side of said housing for engaging a gas input pipe;

a second gas conduit means disposed opposite said first conduit means through said housing for engaging a gas output pipe which is connected to said thermostat; and a solenoid valve connected between said first and second conduit means, said solenoid valve having electrical terminals whereby said electrical signal generated by said temperature sensing means is connected to said electrical terminals.

3. The secondary control device as defined in claim 2 wherein said heater has a pilot light and said secondary control device further includes means for bypassing said solenoid valve and said thermostat to provide gas continuously to said pilot light.

* * * * *